United States Patent [19]

Maeda et al.

[11] 3,966,017

[45] June 29, 1976

[54] WORKING RANGE INDICATING DEVICE FOR AERIAL LADDER TRUCK

[75] Inventors: Kikuo Maeda, Tondabayashi; Takashi Tomimoto, Nara, both of Japan

[73] Assignee: Morita Pump Kabushiki Kaisha, Osaka, Japan

[22] Filed: Feb. 12, 1975

[21] Appl. No.: 549,289

[52] U.S. Cl. ..... 182/18; 182/66

[51] Int. Cl.[2] ..... E06C 5/04; E06C 5/34

[58] Field of Search ..... 182/18, 19, 64, 65, 182/66, 67, 68, 2; 212/39 R, 39 MS

[56] References Cited

UNITED STATES PATENTS

| | | | |
|---|---|---|---|
| 2,772,411 | 11/1956 | Cooper | 212/39 |
| 3,122,125 | 2/1964 | Towne | 212/39 |
| 3,223,249 | 12/1965 | Cady | 212/39 |
| 3,238,521 | 3/1966 | Minogue | 212/39 |
| 3,566,386 | 2/1971 | Hamilton | 212/39 |

FOREIGN PATENTS OR APPLICATIONS

| | | | |
|---|---|---|---|
| 958,953 | 2/1957 | Germany | 212/39 |

*Primary Examiner*—Reinaldo P. Machado
*Attorney, Agent, or Firm*—Hall & Houghton

[57] ABSTRACT

A working range indicating device for an aerial ladder truck is arranged so that the variable length and vertical angle of the ladder are mechanically detected and the detected values are indicated on a working range indicating board disposed at the operating stand by means of a single mechanically operable pointer. Merits and details of the construction will be made clear.

2 Claims, 7 Drawing Figures

WORKING RANGE INDICATING DEVICE FOR AERIAL LADDER TRUCK

BACKGROUND OF THE INVENTION

1. Field of the Invention

The present invention relates to a working range indicating device for an aerial ladder truck.

2. Description of the Prior Art

The detection of the degree of the ladder of an aerial ladder truck has heretofore been effected by an arrangement in which a number of microswitches are disposed side by side along the first ladder section and the second ladder section is used as a switch actuator. In order to indicate the degree of extension of the ladder, a number of neon lamps are disposed side by side longitudianally of a vertical angle indicating pointer and adapted to be turned on and off by said microswitches.

Such electric detection and indication system, however, can be easily affected by water unless it is made water-proof. Further, it is not only complicated in construction but also liable to develop troubles such as poor electric contact of the switches and malfunction of the contacting mechanism. As a result, the reliablility in the indicating action has been low.

SUMMARY OF THE INVENTION

The present invention is intended to provide a device which is capable of carrying out the detection of the degree of extension and vertical angle of an extensible ladder and the indication of the detected values accurately by mechanical means.

DESCRIPTION OF THE PREFERRED EMBODIMENT

Figure 1:
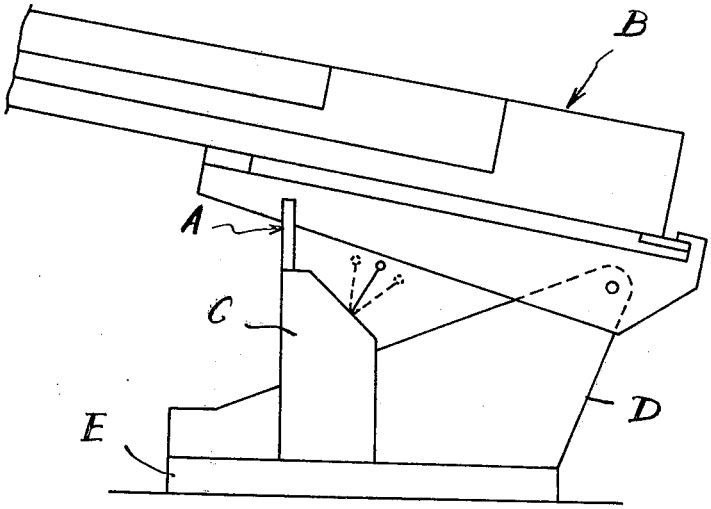
FIG. 1 is a side view of the base portion of the ladder of an aerial ladder truck equipped with an indicating device according to the present invention.

In FIG. 1, the character A designates an indicator according to the present invention to be later described, attached to the operating stand C of a ladder B. The operating stand is mounted on a turntable E disposed laterally of a ladder supporting structure D. As is known in the art, the turntable E is pivotally mounted on the truck body (not shown) so that the operation of the ladder B may be controlled by an operator at the operating stand while watching the indicator A of the present invention.

Figure 2:
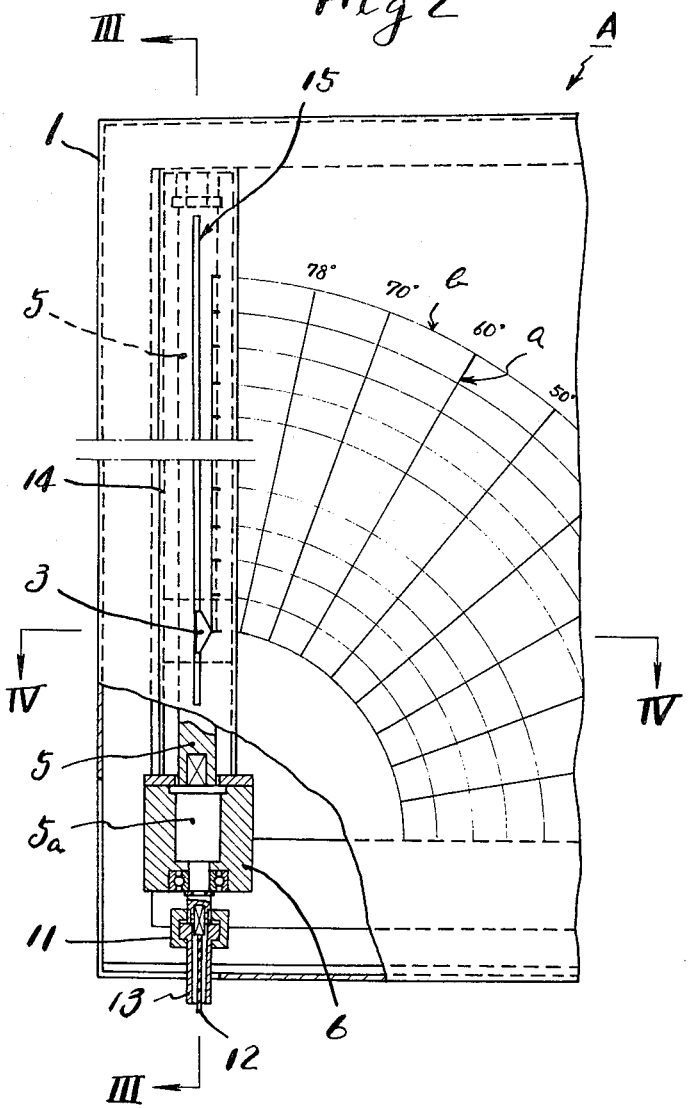
FIG. 2 is an enlarged front view of the present indicating device.
Figure 3:
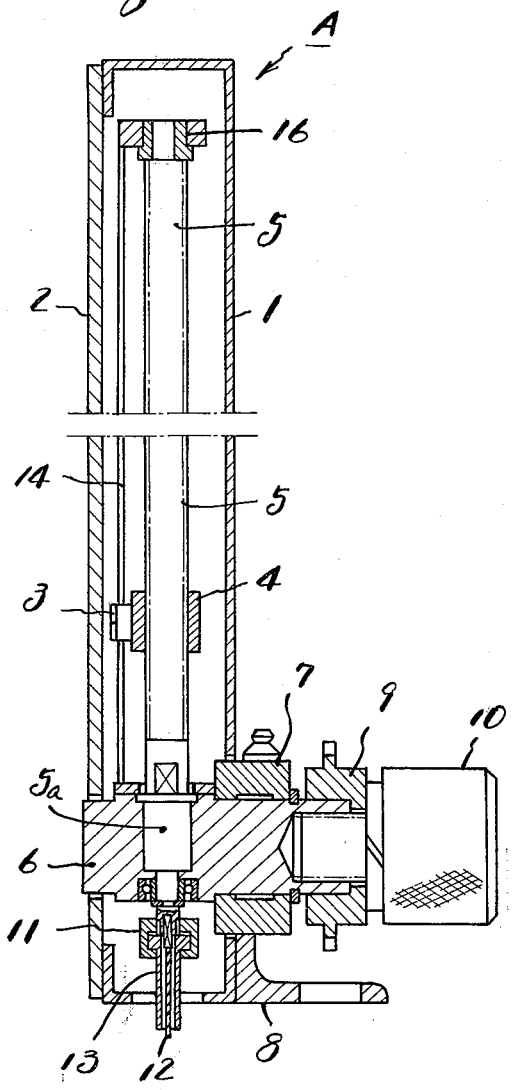
FIG. 3 is a section taken along the line III—III of FIG. 2.
Figure 4:
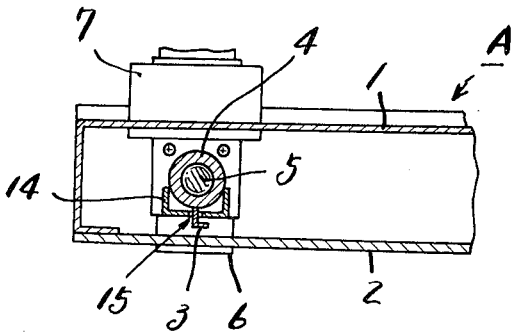
FIG. 4 is a section taken along the line IV—IV of FIG. 2.

Details of the present indicator A are shown in FIGS. 2 through 4, in which the character 1 designates a case body; 2, a transparent gage plate secured to the front surface of said case body; and 3 designates a movable pointer provided within the case body. The movable pointer is threadedly carried on a threaded bar 5 through a nut 4. The base portion 5*a* of the threaded bar extends through a pointer spindle 6 at right angles with the latter and rotatably supported therein. The spindle 6 is located at a corner of the case body and journaled so as to extend transversely through the case body. More particularly, the spindle is rotatably supported in a bearing sleeve 7 at the back of the case body 1. The bearing sleeve is fixed to a case attaching bracket 8 fixed in position behind the case body 1.

The spindle has a sprocket wheel 9 clamped to the rear end thereof by a clamping bolt 9.

Rotation from means for detecting the vertical angle of the ladder is imparted to said sprocket wheel 9 to rotate the threaded bar 6, as will be later described in more detail. The rotation of the spindle 6 results in tilting the threaded bar 5, whereby the vertical angle of the ladder is indicated.

The transparent gage plate 2 is provided with scale marks *a* indicating the vertical angle of the ladder, said scale marks being equispaced and extending radially outwards with the center at the axis of rotation of the spindle 6. It is also provided with arcuate scale marks *b* indicating the degree of extension of the ladder.

The end of the threaded bar 5 on the base side thereof is connected to a flexible shaft 12 through a coupling nut 11. As for the connection between the flexible shaft and the threaded bar, the end surface of the threaded bar 5 is provided with a square opening for receiving a relatively short square shaft which is fixed to the end of the flexible shaft 12. The flexible shaft is covered with a protective tube 13. Rotation from means for converting the extension or contraction of the ladder into rotation is imparted to said flexible shaft to move the movable pointer 3 through the nut 4.

The prevention of rotation of said nut 4 is achieved in that the movable pointer 3 projects through a slit 15 centrally formed in a cover 14 which covers the threaded bar 5 and which is fixed to the spindle 6. In addition, the front end of the threaded bar is rotatably supported in a bearing member 16 mounted on the front end of the cover 14.

The pitch of the thread of the bar 5 is determined from the relation between the scale marks *b* on the gage plate 2 indicating the degree of extension and the means for converting the extension or contraction of the ladder into rotation.

Figure 5:
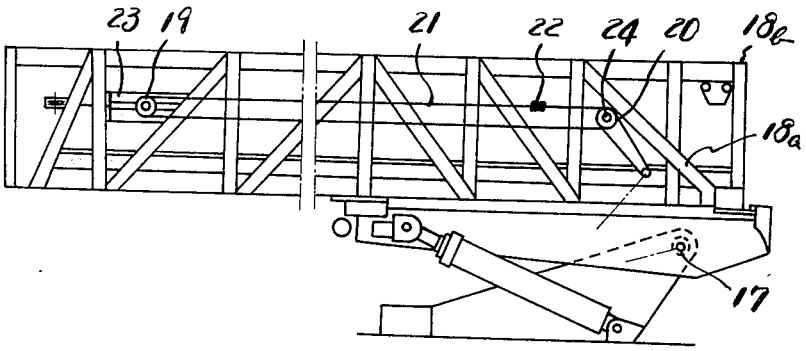
FIG. 5 is a side view showing means for detecting the degree of extension and means for detecting vertical angle according to the present invention.

The means for detecting the vertical angle of the ladder will now be described. As shown in FIG. 5, it comprises a sprocket wheel (not shown) fixedly mounted on a pivot 17 around which the ladder is turned, the rotation of said sprocket wheel being transmitted to the above-mentioned sprocket wheel 9 on the spindle 6 through suitable intermediate sprocket wheels. In this case, the gear ratio between the sprocket wheel 9 and the sprocket wheel on the pivot is 1 : 1, so that the vertical angle of the ladder is transmitted directly to the spindle 6 to tilt the threaded bar 5 through an angle corresponding to said vertical angle.

Further, the means for converting the extension or contraction of the ladder into rotation is constructed in the following way.

Figure 6:
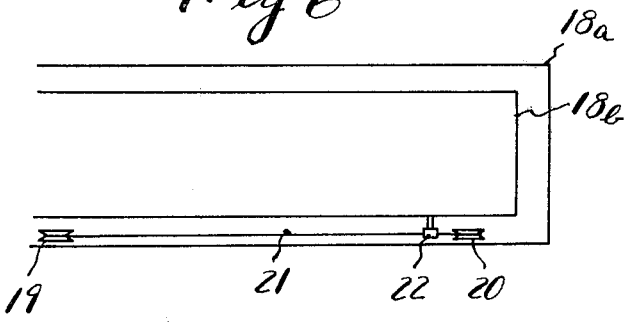
FIG. 6 is a plan view thereof for explanation purposes.

As shown in FIGS. 5 and 6, pulleys 19 and 20 are provided on both ends of the first ladder section 18*a* and a wire 21 is mounted taut between said pulleys, a portion of said wire being clamped by a clamping member 22 projecting from adjacent the lower end of the second ladder section 18*b*. With this arrangement, when the second ladder section 18*b* is projected or retracted, the pulleys 19 and 20 are rotated through the wire 21. One pulley 19 is pulled by tension means 23, whereby it is maintained under tension. The other pulley 20 is fixed in position and the rotatable shaft 24 of this pulley 20 has connected thereto the other end of the above-mentioned flexible shaft 12.

Figure 7:
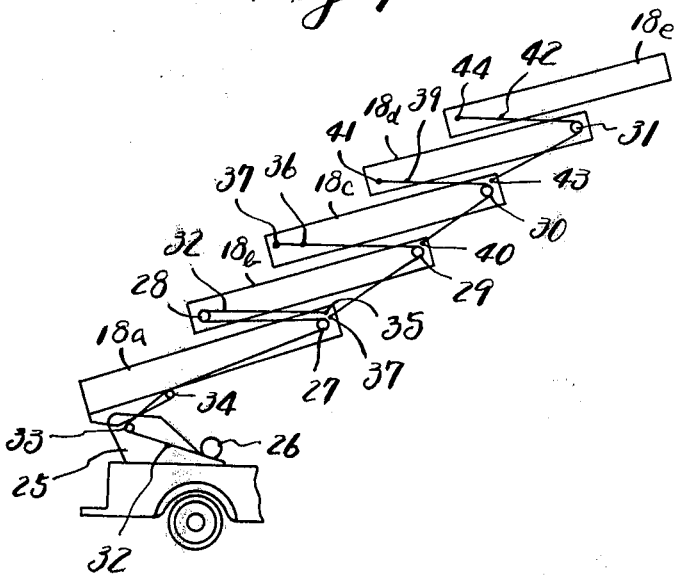
FIG. 7 is a side view of a ladder extending and contracting mechanism for explanation purposes.

Referring to FIG. 7, the extension and contraction of the ladder is effected by the operation of a winding drum 26 mounted on a turntable 25. The extensible ladder consists of the first, second, third, fourth and fifth ladder sections 18*a*, 18*b*, 18*c*, 18*d* and 18*e*, respectively, of different widths. Although these sections are shown separated from each other for clarification purposes, actually the second ladder 18*b* is slidably fitted in the first ladder section 18*a*, the third ladder section 18*c* in the second ladder section 18*b*, the fourth ladder section 18*d* in the third ladder section 18*c* and the fifth ladder section 18*e* in the fourth ladder section 18*d*. Further, the front end of the first ladder section 18 *a* is provided with a pulley 27, the front and rear ends of the second ladder section 18*b* with pulleys 28 and 29, the front end of the third ladder section 18*c* with a pulley 30 and the front end of the fourth ladder section 18*d* with a pulley 31.

A ladder extending and contracting rope 32 extends from said winding drum 26, passing successively around a pulley 33 on the turntable 25 and a pulley 34 on the base portion of the first ladder section 18a and then around said pulleys 27 and 28, the front end of said rope 32 being tied to the front end 35 of the first ladder section 18*a*. Further, a rope 36 of predetermined length is passed around the pulley 29 and one end of said rope is tied to the front end 37 of the first ladder section 18*a*, the other end of said rope being tied to the rear end 38 of the third ladder section 18*c*. Similarly, a rope 39 of predetermined length is passed around the pulley 30 and one end of said rope is tied to the front end 40 of the second ladder section 18*b*, the other end of said rope being tied to the rear end 41 of the fourth ladder section 18*d*. Finally, a rope 42 of predetermined length is passed around the pulley 31 and one end of said rope is tied to the front end 43 of the third ladder section 18*c*, the other end of said rope being tied to the rear end 44 of the fifth ladder section 18*e*.

With this rope arrangement, it will be seen that if the rope 32 is taken up by the drum 26, the rope 32 outwardly moves the second ladder section 18*b;* as the second ladder section is outwardly moved, the rope 36 outwardly moves the third ladder section 18*c;* as the third ladder section is outwardly moved, the rope 39 outwardly moves the fourth ladder section 18*d;* and as the fourth ladder section is outwardly moved, the rope 42 outwardly moves the fifth ladder section 18*e*. Thus, if the second ladder section 18b is outwardly moved through a distance *l* from the first ladder section 18*a*, then the other ladder sections, namely, the third, fourth and fifth ladder sections 18*c*, 18*d* and 18*e* are simultaneously outwardly moved through the same distance *l*, so that the total amount extended is 4*l*. Further, if the rope 32 is unwound, the second ladder section 18b is retracted under its own weight; as the second ladder section is retracted, the rope 36 is slackened to allow the third ladder section 18*c* to be retracted; as the third ladder section is retracted, the rope 39 is slackened to allow the fourth ladder section 18*d* to be retracted; and as the fourth ladder section is retracted, the rope 42 is slackened to allow the fifth ladder section to be retracted. Thus, if the second ladder section 18*b* is retracted into the first ladder section 18*a* through a distance l, then the other ladder sections, namely, the third, fourth and fifth ladder sections 18*c*, 18*d* and 18*e* are simultaneously retracted through the same distance *l*, so that the total amount retracted is 4l.

With the ladder extending and contracting mechanism constructed in the manner described above, for an extensible ladder having n sections if the amount of extension or contraction detected by the method shown in FIGS. 5 and 6 is *l*, the total amount of extension or contraction is $l(n-1)$. Since n is known, the total amount of extension or contraction can be determined.

As has been described thus far, according to the present invention, the degree of extension and vertical angle of the ladder can be mechanically and continuously detected and indicated without error or mulfunction. Since the indicator is located on the operating stand of the ladder, it is very easy to observe the indicator and the ladder can be safely operated. Further, it is rugged and highly resistant to vibration and seldom gets out of order. It is no longer necessary to make the extension detecting part water-proof and the construction is easy and inexpensive.

Whiles there have been described herein what are at present considered preferred embodiments of the several features of the invention, it will be obvious to those skilled in the art that modifications and changes may be made without departing from the essence of the invention.

It is therefore to be understood that the exemplary embodiments thereof are illustrative and not restrictive of the invention, the scope of which is defined in the appended claims and that all modifications that come within the meaning and range of equivalency of the claims are intended to be included therein.

What is claimed is:

1. In an aerial ladder truck assembly having a turntable mounted on the body of the truck, ladder supporting means mounted on the turntable, an extensible, sectional ladder unit pivotally mounted at one end to said ladder supporting means, means to pivot the ladder unit, means to extend and contract the ladder sections of the ladder unit, and an operating stand mounted on the turntable, the improvement of a ladder unit working range indicator mounted on the operating stand for simultaneously indicating the vertical angle and the degree of extension of the ladder unit, said working range indicator comprising a casing body member mounted on said operating stand, a transparent gauge plate having a fixed point adjacent its lower edge mounted on said casing body member, said gauge plate having a plurality of vertical angle indicating scale marks present thereon, said vertical angle indicating marks each extending radially outwardly from the fixed point and in laterally spaced, equidistance relationship with respect to one another to provide a range of laterally spaced different angle values, said gauge plate further having a plurality of arcuate linear distance indicating scale marks present thereon, said arcuate linear distance indicating scale marks each extending outwardly from the fixed point in longitudinally spaced relationship to and in arcuate configuration with respect to one another to provide a range of outwardly progressing different linear space values, bar element means pivotally mounted at its bottom end to said casing body member at a point generally coinciding with the fixed point on said gauge plate, said bar element journaled for rotation about its longitudinal axis and pivotally mounted for movement back and forth over the face of said gauge plate, said bar element means including an elongated threaded portion, a nut element threadably mounted thereon, scale indicating means associated with said nut element, and means permitting the axial movement of the nut element along the elongated threaded portion upon rotation of the threaded portion about its longitudinal axis, first actuating means operatively connected between said bar element means and the means for pivoting the ladder unit to pivot said bar element means over the vertical angle indicating scale marks on said gauge plate to indicate the vertical angle of the ladder unit, and second actuating means operatively connected between the base element means and the means for extending and contracting the ladder unit to rotate the bar element means about its vertical axis causing the indicating means carried by the nut element to move axially along the threaded portion and over the linear distance indicating scale marks of the gauge plate to indicate the distance of contraction or expansion of the ladder unit.

2. In an aerial ladder truck assembly having a turntable mounted on the body of the truck, ladder supporting means mounted on the turntable, an extensible, sectional ladder unit pivotally mounted at one end to said ladder supporting means, means to pivot the ladder unit, means to extend and contract the ladder sections of the ladder unit, and an operating stand mounted on the turntable, the improvement of a ladder unit working range indicator mounted on the operating stand for indicating the vertical angle and the degree of extension of the ladder unit, said working range indicator comprising a casing body member mounted on said operating stand, a transparent gauge plate having a fixed point adjacent its lower edge mounted on said casing body member, said gauge plate having a plurality of vertical angle indicating scale marks present thereon, said vertical angle indicating marks each extending radially outwardly from the fixed point and in laterally spaced, equidistance relationship with respect to one another to provide a range of laterally spaced different angle values, said gauge plate further having a plurality of arcuate linear distance indicating scale marks present thereon, said arcuate linear distance indicating scale marks each extending outwardly from the fixed point in longitudinally spaced relationship to and in arcuate configuration with respect to one another to provide a range of outwardly progressing different linear distance values, pointer spindle means mounted on said casing body member, said pointer spindle means including a rotatable shaft mounted in transverse relationship on said casing body member and in generally coinciding relationship with the fixed point on said gauge plate, a rotatable threaded bar member having its bottom base end rotatably supported by and extending through said shaft member at right angles thereto, a cover element having mounted in spaced, parallel relationship with respect to said cover element having an elongated slot extending axially therealong in parallel relationship to said bar member, a nut element threadably mounted on said threaded bar member, said nut element including a pointer member secured at one end thereto and the remainder thereof slidably positioned in the elongated slot of said cover element for axial movement therein upon rotation of said bar member, a sprocket wheel means mounted at the back end of said shaft member for rotation thereof, means detecting the vertical angle of the ladder unit means operatively associated with said sprocket wheel means for rotation of said shaft member and hence the bar member to indicate on the vertical angle indicating scale mark of said gauge plate the actual angle of the ladder unit, means for converting the axial extension or contraction of the ladder unit into rotational movement operatively connected to the bottom base end of said bar member whereby the pointer member of said nut element will move axially in the slot of the cover member and over the linear distant arcuate scale marks on the gauge plate to indicate thereon the actual contraction or expansion distance of the ladder unit.

* * * * *